US011504842B1

(12) United States Patent
Thompson

(10) Patent No.: US 11,504,842 B1
(45) Date of Patent: Nov. 22, 2022

(54) COLLAPSIBLE SAWHORSE

(71) Applicant: Donald Thompson, Glen Burnie, MD (US)

(72) Inventor: Donald Thompson, Glen Burnie, MD (US)

( * ) Notice: Subject to any disclaimer, the term of this patent is extended or adjusted under 35 U.S.C. 154(b) by 0 days.

(21) Appl. No.: 17/093,719

(22) Filed: Nov. 10, 2020

(51) Int. Cl.
*B25H 1/06* (2006.01)

(52) U.S. Cl.
CPC ..... *B25H 1/06* (2013.01)

(58) Field of Classification Search
CPC .. B27B 21/10; B25H 1/06; B25H 1/04; A47B 2200/0016; A47B 2230/0085; A47B 13/00; A47B 13/021; A47B 13/088; A47B 2003/008; A47B 2003/08; A47B 3/12; A47B 47/042; A47B 83/02
USPC .... 182/129, 151, 153, 155, 181, 225, 186.5; 269/289; 144/285, 286.1
See application file for complete search history.

(56) References Cited

U.S. PATENT DOCUMENTS 1,996,761 A * 4/1935 Gould ..... E04G 1/32 182/224
2,911,265 A * 11/1959 Hannah ..... A47B 3/12 182/186.5
3,035,660 A * 5/1962 Leon ..... B25H 1/06 182/186.5
4,124,093 A 11/1978 Breisch
4,182,432 A * 1/1980 Cossitt ..... B25H 1/06 182/151
4,574,917 A * 3/1986 Stoddard ..... B25H 1/06 108/56.1
4,890,693 A * 1/1990 O'Brien ..... B25H 1/06 182/151
4,923,051 A * 5/1990 Newville ..... B25H 1/06 182/151
5,257,829 A 11/1993 Weeks
5,265,697 A * 11/1993 Quick ..... B25H 1/06 182/151
5,779,003 A 7/1998 Carty
D493,236 S 7/2004 Frey
7,111,708 B2 * 9/2006 Frey ..... B25H 1/04 182/151
8,439,165 B2 5/2013 Busschert
2011/0056768 A1 3/2011 Budreau
2017/0120439 A1 5/2017 Taron
2017/0312909 A1 11/2017 Brunner

* cited by examiner

*Primary Examiner* — Lee D Wilson
*Assistant Examiner* — Jonathan G Santiago Martinez
(74) *Attorney, Agent, or Firm* — Kyle A. Fletcher, Esq.

(57) ABSTRACT

The collapsible sawhorse comprises a cross tie, a first vertical support member, and a second vertical support member. The collapsible sawhorse may be a sawhorse that separates and collapses for transportation and storage. When assembled, the collapsible sawhorse may be used to elevate and support a project. The collapsible sawhorse may be used in pairs to elevate both ends of the project. As non-limiting examples, the project may be a construction material such as a board to be sawed, a temporary work surface such as a sheet of plywood, or a tool such as a chop saw. The collapsible sawhorse may be fastenerless in that the collapsible sawhorse may be assembled and disassembled without using tools.

17 Claims, 5 Drawing Sheets

COLLAPSIBLE SAWHORSE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction tools, more specifically, a collapsible sawhorse.

SUMMARY OF INVENTION

The collapsible sawhorse comprises a cross tie, a first vertical support member, and a second vertical support member. The collapsible sawhorse may be a sawhorse that separates and collapses for transportation and storage. When assembled, the collapsible sawhorse may be operable to elevate and support a project. The collapsible sawhorse may be used in pairs to elevate both ends of the project. As non-limiting examples, the project may be a construction material such as a board to be sawed, a temporary work surface such as a sheet of plywood, or a tool such as a chop saw. The collapsible sawhorse may be fastenerless in that the collapsible sawhorse may be assembled and disassembled without using tools.

An object of the invention is to provide a sawhorse for elevating and supporting a project.

Another object of the invention is to provide a sawhorse that may be separated into a cross tie, a first vertical support member, and a second vertical support member.

A further object of the invention is to provide a sawhorse that may be stored by first stacking the separated cross tie, first vertical support member, and second vertical support member.

Yet another object of the invention is to provide a sawhorse that may be assembled without using tools.

These together with additional objects, features and advantages of the collapsible sawhorse will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible sawhorse in detail, it is to be understood that the collapsible sawhorse is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible sawhorse.

It is therefore important that the claims be regarded as including such equivalent construction insofar as they do not depart from the spirit and scope of the collapsible sawhorse. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
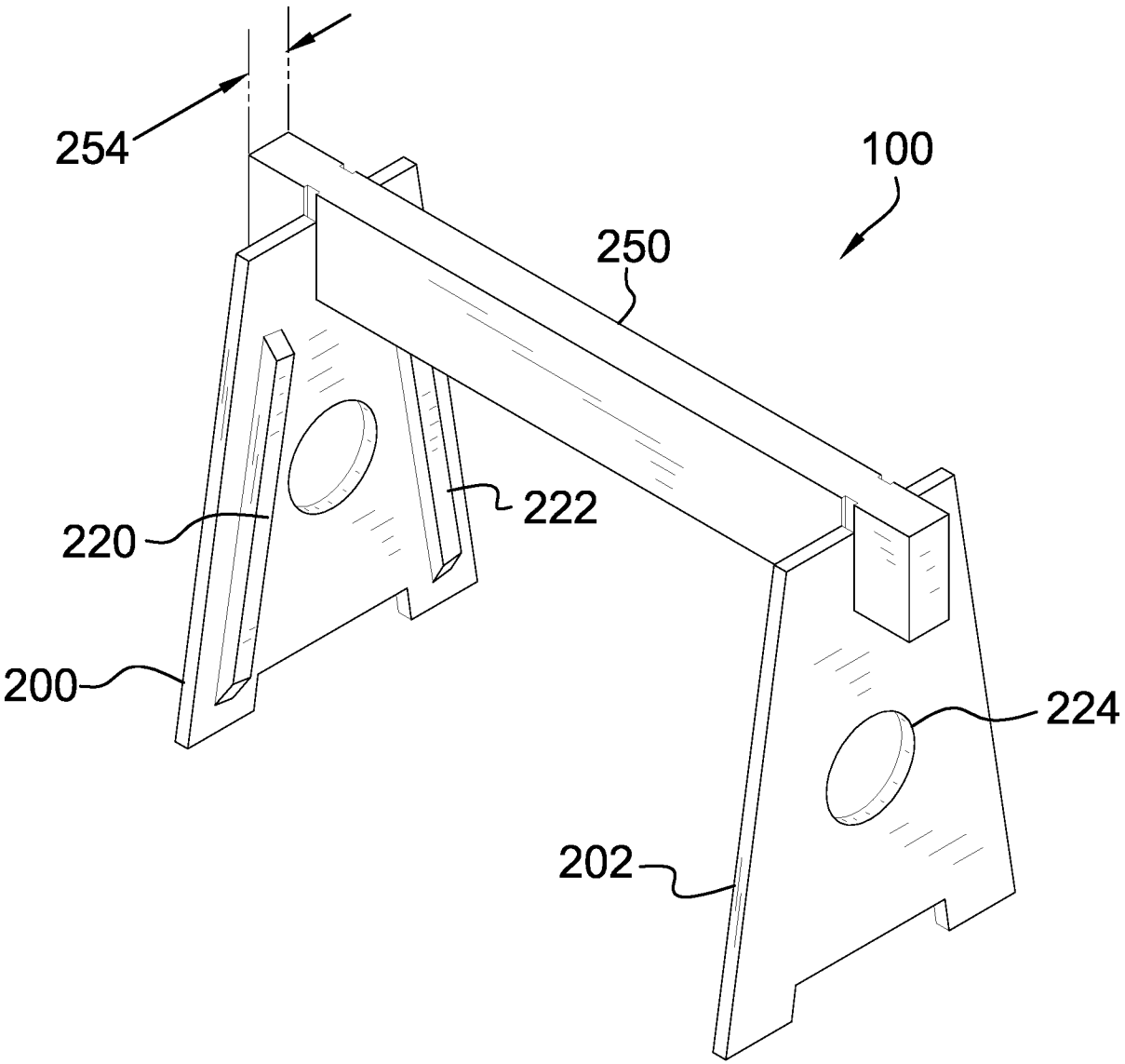
FIG. 1 is an isometric view of an embodiment of the disclosure.
Figure 3:
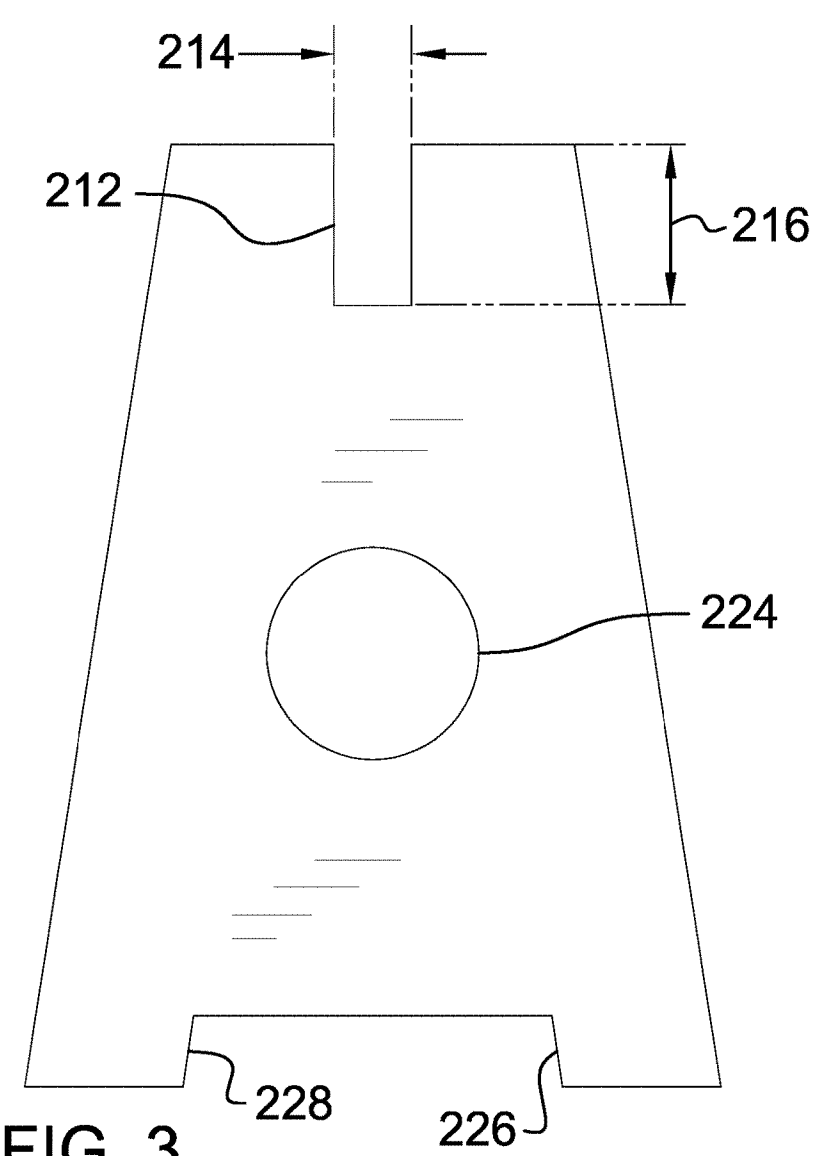
FIG. 3 is a rear view of an embodiment of the disclosure illustrating an individual vertical support member.
Figure 2:
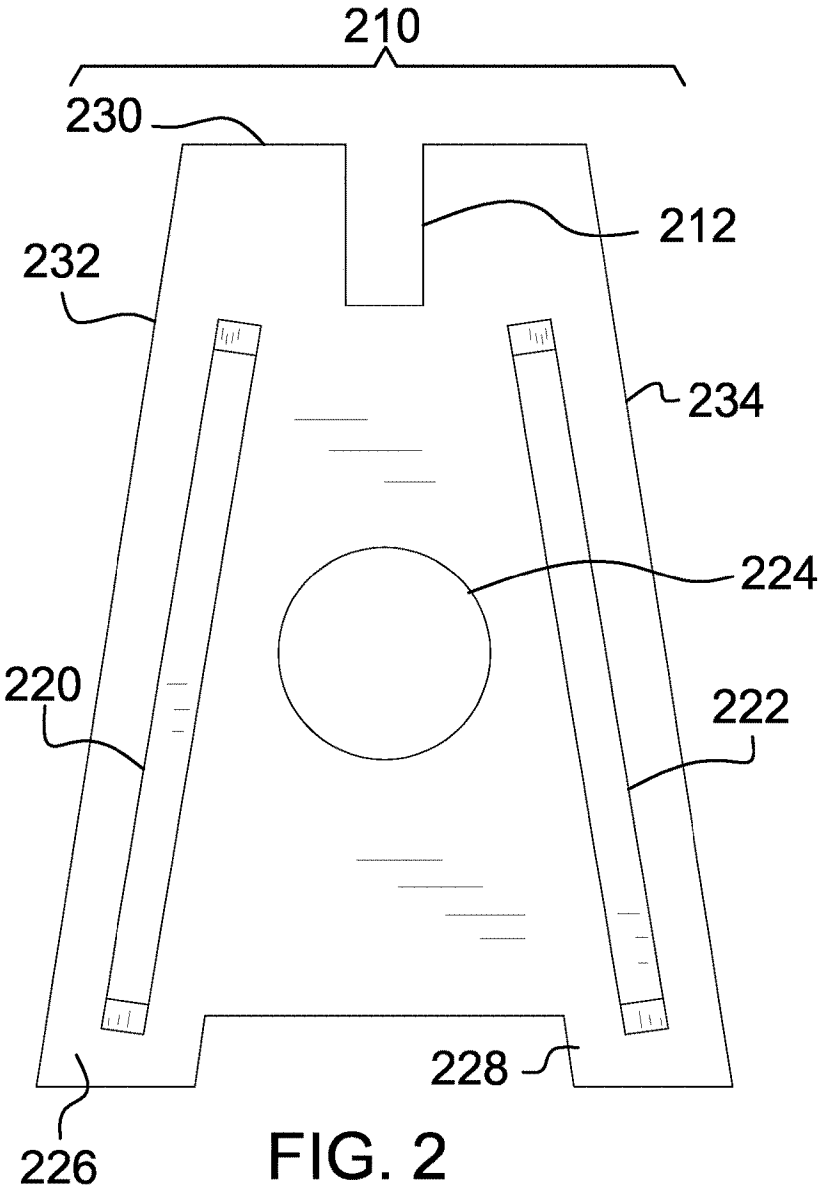
FIG. 2 is a front view of an embodiment of the disclosure illustrating an individual vertical support member.
Figure 5:
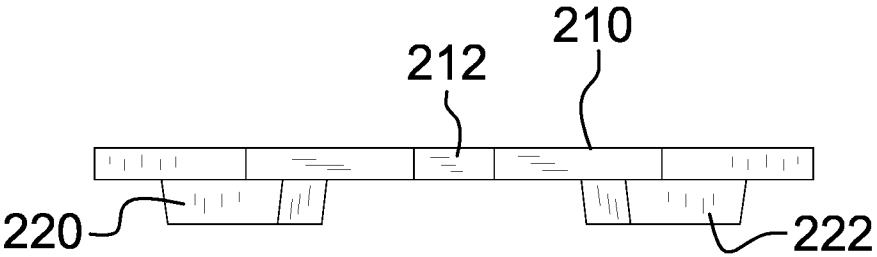
FIG. 5 is a top view of an embodiment of the disclosure illustrating an individual vertical support member.
Figure 6:
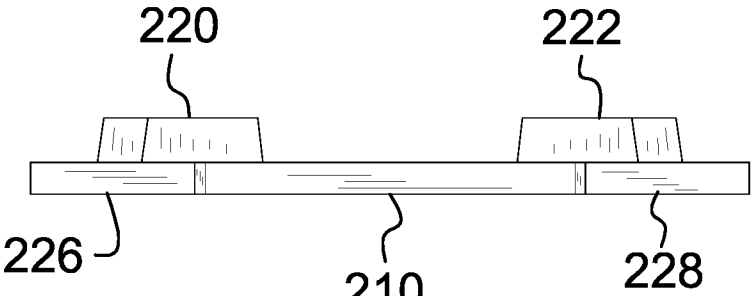
FIG. 6 is a bottom view of an embodiment of the disclosure illustrating an individual vertical support member.
Figure 4:
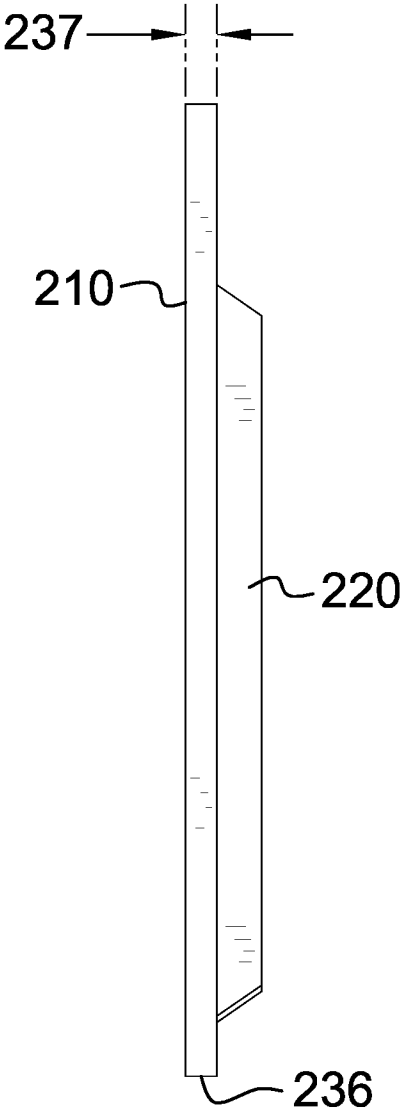
FIG. 4 is a side view of an embodiment of the disclosure illustrating an individual vertical support member.
Figure 7:
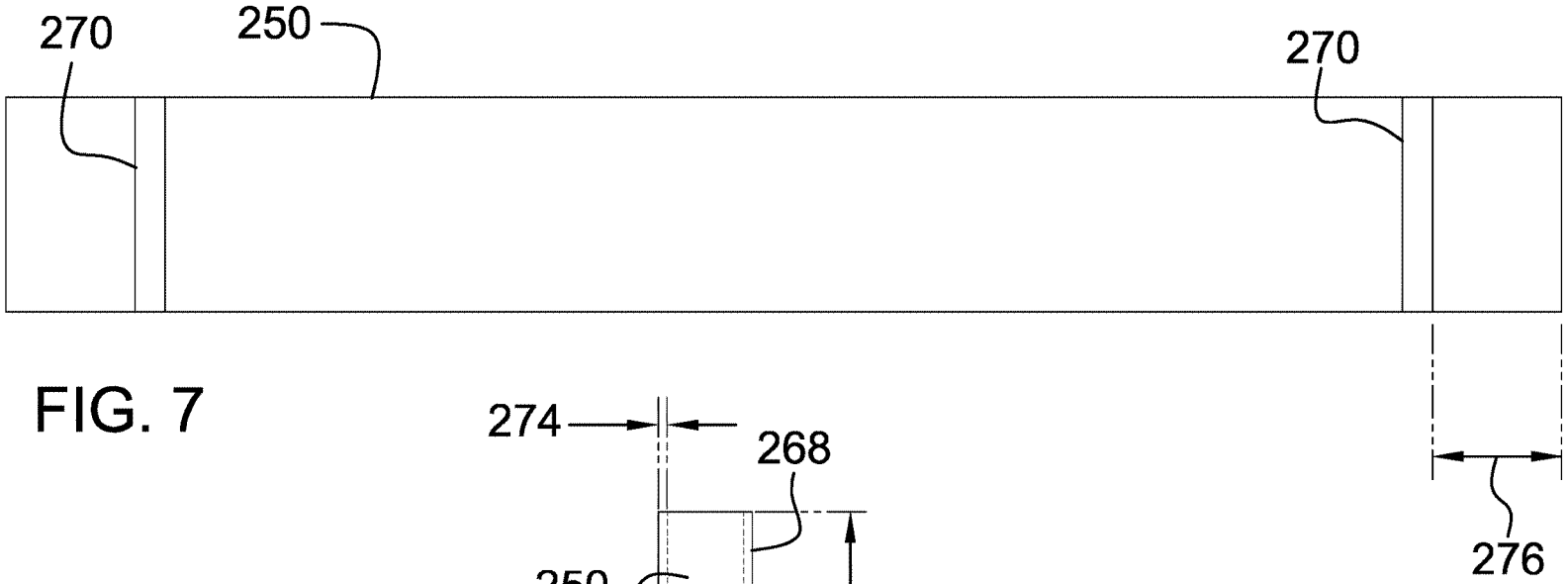
FIG. 7 is a front view of an embodiment of the disclosure illustrating the cross tie.
Figure 8:
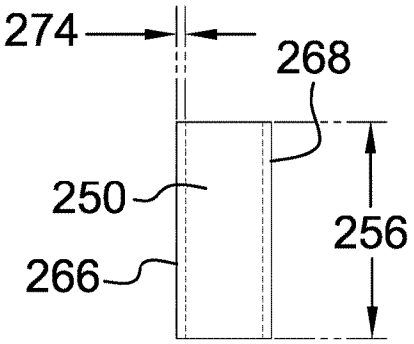
FIG. 8 is a side view of an embodiment of the disclosure illustrating the cross tie.
Figure 9:
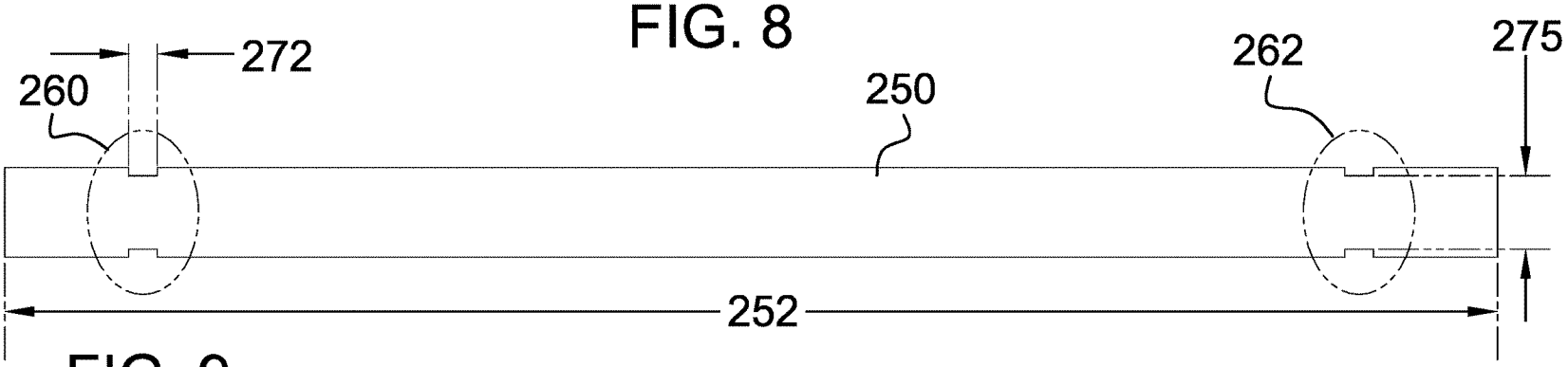
FIG. 9 is a top view of an embodiment of the disclosure illustrating the cross tie.
Figure 10:
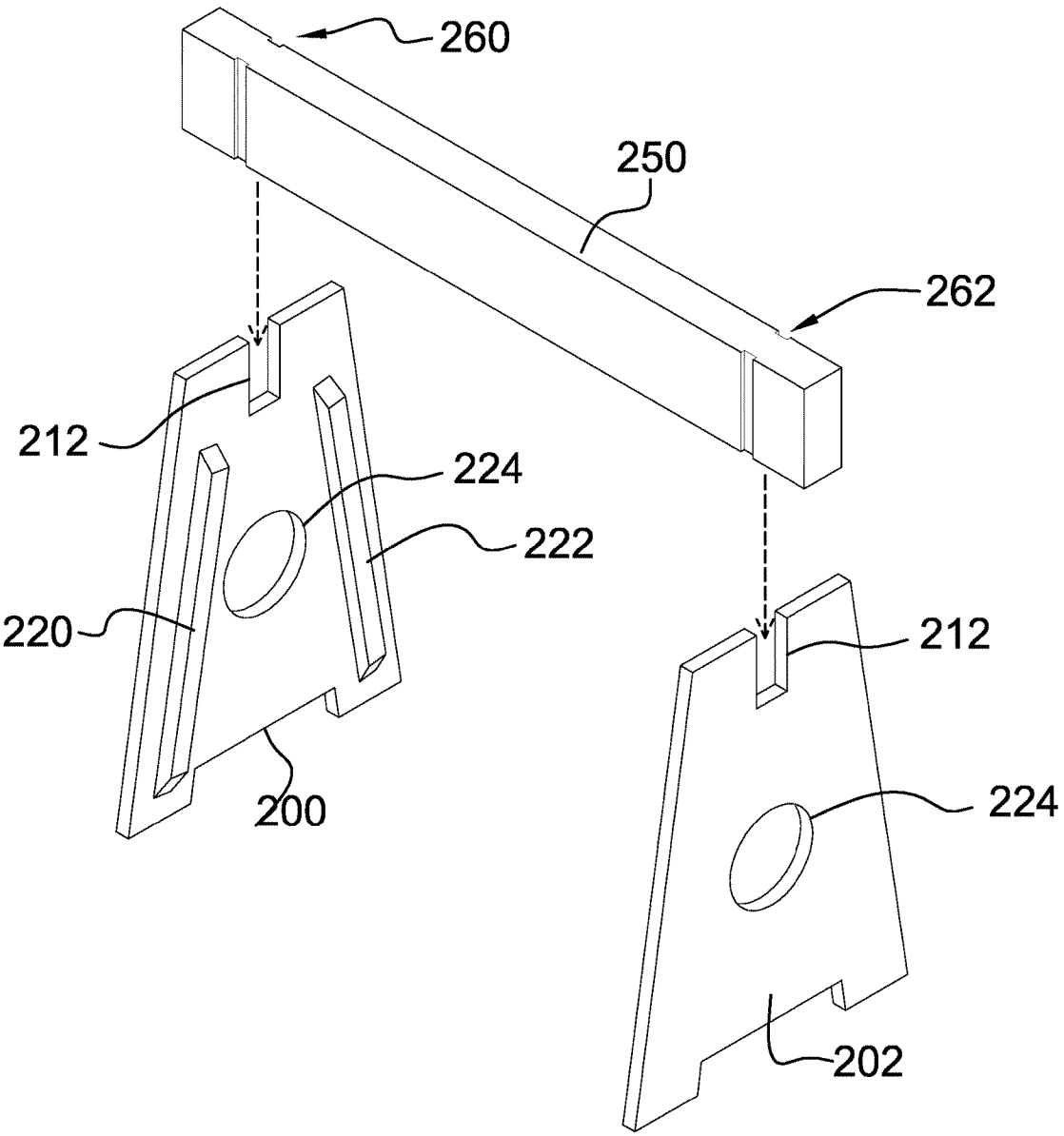
FIG. 10 is an exploded view of an embodiment of the disclosure.

Detailed reference will now be made to a first potential embodiment of the disclosure, which is illustrated in FIGS. 1 through 10.

The collapsible sawhorse 100 (hereinafter invention) comprises a cross tie 250, a first vertical support member 200, and a second vertical support member 202. The invention 100 may be a sawhorse that separates and collapses for transportation and storage. When assembled, the invention 100 may be used to elevate and support a project. The invention 100 may be used in pairs to elevate both ends of the project. As non-limiting examples, the project may be a construction material such as a board to be sawed, a temporary work surface such as a sheet of plywood, or a tool such as a chop saw. The invention 100 may be fastenerless. The invention 100 may be assembled and disassembled without using tools.

The cross tie 250 may be a beam that straddles the first vertical support member 200 and the second vertical support member 202 to form the sawhorse. The cross tie 250 may generally be the shape of a rectangular prism. The cross tie 250 may be defined by a cross tie length 252, a cross tie width 254, and a cross tie height 256.

The cross tie 250 may comprise a first pair of interlocking grooves 260 and a second pair of interlocking grooves 262. The first pair of interlocking grooves 260 and the second pair of interlocking grooves 262 may be located at opposing ends of the cross tie 250 and may be inset from the ends of the cross tie 250.

An individual pair of interlocking grooves selected from the first pair of interlocking grooves 260 and the second pair of interlocking grooves 262 may comprise a first groove 266 and a second groove 268. The first groove 266 and the second groove 268 may be on opposing sides of the cross tie 250 at an offset distance 276 from the nearest end of the cross tie 250. The first groove 266 and the second groove 268 may be vertically oriented and may extend for the cross tie height 256 from the top of the cross tie 250 to the bottom of the cross tie 250. The first groove 266 and the second groove 268 create a narrowing of the cross tie 250.

An individual groove 270 selected from the first groove 266 and the second groove 268 may comprise a groove width 272 and a groove depth 274. The groove depth 274 may narrow the cross tie 250 to a first thickness 275 at the individual pair of interlocking grooves.

The first vertical support member 200 may couple to the first pair of interlocking grooves 260 of the cross tie 250. The second vertical support member 202 may couple to the second pair of interlocking grooves 262 of the cross tie 250. The first vertical support member 200 and the second vertical support member 202 may elevate the cross tie 250 above ground level.

An individual vertical support member 210 selected from the first vertical support member 200 and the second vertical support member 202 may be the shape of an isosceles trapezoid with the parallel edges of the trapezoid located at the top and bottom of the individual vertical support member 210. A top edge 230 of the individual vertical support member 210 may be narrower than a bottom edge 236 of the individual vertical support member 210. A second thickness 237 of the individual vertical support member 210 may be no greater than the groove width 272 of the individual grooves 270 on the cross tie 250.

The individual vertical support member 210 may comprise an interlocking slot 212 located at the center of the top edge 230. The interlocking slot 212 may be a notch that the cross tie 250 may be placed into to interlock the individual vertical support member 210 and the cross tie 250. The interlocking slot 212 may comprise a slot width 214 and a slot depth 216. The slot width 214 may be at least as large as the first thickness 275 of the cross tie 250. In some embodiments, the slot depth 216 may be less than or equal to the cross tie height 256.

The individual vertical support member 210 may comprise a first stiffener 220 and a second stiffener 222. The first stiffener 220 and the second stiffener 222 may be projections from the face of the individual vertical support member 210. The first stiffener 220 and the second stiffener 222 may add stiffness to the individual vertical support member 210 and may prevent the individual vertical support member 210 from bending when a load is placed on top of the cross tie 250. The first stiffener 220 and the second stiffener 222 may be oriented to run parallel to a left edge 232 and a right edge 234 of the individual vertical support member 210.

In some embodiments, the individual vertical support member 210 may comprise a left leg 226 and a right leg 228. The left leg 226 and the right leg 228 may be downward extensions of the left and right sides of the individual vertical support member 210.

In some embodiments, the individual vertical support member 210 may comprise one or more cutouts 224. The one or more cutouts 224 may be one or more apertures in the face of the individual vertical support member 210. The one or more cutouts 224 may reduce the weight of the individual vertical support member 210 and/or may reduce the amount of material needed to fabricate the individual vertical support member 210. As non-limiting examples, the first vertical support member 200, the second vertical support member 202, the cross tie 250, or combinations thereof may be made of wood, plastic, metal, or composites.

The invention 100 may be collapsed for storage by separating the first vertical support member 200 and the second vertical support member 202 from the cross tie 250 and by sandwiching the cross tie 250 between the first vertical support member 200 and the second vertical support member 202. The first vertical support member 200 and the second vertical support member 202 may be oriented to face in opposite directions with the first stiffener 220 and the second stiffener 222 of each of the individual vertical support members 210 located between the individual vertical support members 210 such the footprint of the collapsed sawhorse is minimized.

In use, the invention 100 may be assembled into a sawhorse by orienting a first vertical support member 200 and a second vertical support member 202 with interlocking slots 212 on top and by placing a cross tie 250 onto the first vertical support member 200 and into the second vertical support member 202 such that a first pair of interlocking grooves 260 on the cross tie 250 interlock with the interlocking slot 212 on the first vertical support member 200 and a second pair of interlocking grooves 262 on the cross tie 250 interlock with the interlocking slot 212 on the second vertical support member 202. A project may then be supported on top of the sawhorse (perhaps in conjunction with a second sawhorse) to make the project more convenient to work on. When no longer needed, the first vertical support member 200 and the second vertical support member 202 may be separated from the cross tie 250 and stacked with the cross tie 250 between the first vertical support member 200 and the second vertical support member 202 for storage or transportation.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used here, "footprint" may refer to a vertical, downward projection of an object onto the surface that supports the object. The portion of the supporting surface that is within the footprint is, by definition, underneath the object.

As used in this disclosure, the term "load" may refer to an object upon which a force is acting or which is otherwise absorbing energy in some fashion. As non-limiting examples, a mass that is being moved a distance or an electrical circuit element that draws energy. The term load may also be used to refer to a force that is applied to a stationary structure.

As used in this disclosure, a "notch" may be an indentation formed in an edge or a cavity or aperture formed within a surface.

As used in this disclosure, a "prism" may be a 3 dimensional geometric structure wherein the form factor of two faces of the prism are congruent and the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used in this disclosure, a "slot" may be a long narrow groove, cut, opening, or aperture that is formed in or through an object.

As used in this disclosure, the terms "stiff", "stiffer", and "stiffness" are comparative terms that may be used to compare the relative rigidity of two objects. Specifically, if a given force is applied to a first object and to a second object, the object that deforms less is said to be stiffer or more stiff than the object that displayed greater deformation. Alternatively, it may be said that the object that deforms less possesses more stiffness.

As used in this disclosure, a "tool" may be a device, an apparatus, or an instrument that is used to carry out an activity, operation, or procedure.

As used in this disclosure, a "trapezoid" may be a quadrilateral with one pair of parallel sides. An isosceles trapezoid is a trapezoid for which a line of symmetry intersects opposite sides of the trapezoid and bisects the trapezoid into two congruent shapes or structures.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A collapsible sawhorse comprising:

a cross tie, a first vertical support member, and a second vertical support member;

wherein the collapsible sawhorse is a sawhorse that separates and collapses for transportation and storage;

wherein when assembled, the collapsible sawhorse is operable to elevate and support a project;

wherein the collapsible sawhorse is fastenerless;

wherein the collapsible sawhorse is assembled and disassembled without using tools;

wherein an individual vertical support member selected from the first vertical support member and the second vertical support member is the shape of an isosceles trapezoid with the parallel edges of the trapezoid located at the top and bottom of the individual vertical support member;

wherein the individual vertical support member comprises a left leg and a right leg;

wherein the left leg and the right leg are downward extensions of the left and right sides of the individual vertical support member;

wherein the individual vertical support member comprises a first stiffener and a second stiffener;

wherein the first stiffener and the second stiffener are projections from the face of the individual vertical support member;

wherein the first stiffener and the second stiffener add stiffness to the individual vertical support member and prevent the individual vertical support member from bending when a load is placed on top of the cross tie.

2. The collapsible sawhorse according to claim 1 wherein the cross tie is a beam that straddles the first vertical support member and the second vertical support member to form the sawhorse.

3. The collapsible sawhorse according to claim 2 wherein the cross tie is the shape of a rectangular prism;

wherein the cross tie is defined by a cross tie length, a cross tie width, and a cross tie height.

4. The collapsible sawhorse according to claim 3 wherein the cross tie comprises a first pair of interlocking grooves and a second pair of interlocking grooves;

wherein the first pair of interlocking grooves and the second pair of interlocking grooves are located at opposing ends of the cross tie and are inset from the ends of the cross tie.

5. The collapsible sawhorse according to claim 4 wherein an individual pair of interlocking grooves selected from the first pair of interlocking grooves and the second pair of interlocking grooves comprise a first groove and a second groove;

wherein the first groove and the second groove are on opposing sides of the cross tie at an offset distance from the nearest end of the cross tie.

6. The collapsible sawhorse according to claim 5
wherein the first groove and the second groove are vertically oriented and extend for the cross tie height from the top of the cross tie to the bottom of the cross tie.

7. The collapsible sawhorse according to claim 6
wherein the first groove and the second groove create a narrowing of the cross tie.

8. The collapsible sawhorse according to claim 7
wherein an individual groove selected from the first groove and the second groove comprise a groove width and a groove depth;
wherein the groove depth narrows the cross tie to a first thickness at the individual pair of interlocking grooves.

9. The collapsible sawhorse according to claim 8
wherein the first vertical support member couples to the first pair of interlocking grooves of the cross tie;
wherein the second vertical support member couples to the second pair of interlocking grooves of the cross tie;
wherein the first vertical support member and the second vertical support member elevate the cross tie above ground level.

10. The collapsible sawhorse according to claim 8
wherein a top edge of the individual vertical support member is narrower than a bottom edge of the individual vertical support member.

11. The collapsible sawhorse according to claim 10
wherein a second thickness of the individual vertical support member is no greater than the groove width of the individual grooves on the cross tie.

12. The collapsible sawhorse according to claim 11
wherein the individual vertical support member comprises an interlocking slot located at the center of the top edge;
wherein the interlocking slot is a notch that the cross tie is placed into to interlock the individual vertical support member and the cross tie;
wherein the interlocking slot comprises a slot width and a slot depth;
wherein the slot width is at least as large as the first thickness of the cross tie.

13. The collapsible sawhorse according to claim 12
wherein the slot depth is less than or equal to the cross tie height.

14. The collapsible sawhorse according to claim 13
wherein the first stiffener and the second stiffener are oriented to run parallel to a left edge and a right edge of the individual vertical support member.

15. The collapsible sawhorse according to claim 14
wherein the individual vertical support member comprises one or more cutouts;
wherein the one or more cutouts are one or more apertures in the face of the individual vertical support member;
wherein the one or more cutouts reduce the weight of the individual vertical support member and/or reduce the amount of material needed to fabricate the individual vertical support member.

16. The collapsible sawhorse according to claim 15
wherein the first vertical support member, the second vertical support member, the cross tie, or combinations thereof are made of wood, plastic, metal, or composites.

17. The collapsible sawhorse according to claim 15
wherein the collapsible sawhorse is collapsed for storage by separating the first vertical support member and the second vertical support member from the cross tie and by sandwiching the cross tie between the first vertical support member and the second vertical support member;
wherein the first vertical support member and the second vertical support member are oriented to face in opposite directions with the first stiffener and the second stiffener of each of the individual vertical support members located between the individual vertical support members such the footprint of the collapsed sawhorse is minimized.

* * * * *